US009666924B2

(12) United States Patent
Pacaud et al.

(10) Patent No.: US 9,666,924 B2
(45) Date of Patent: May 30, 2017

(54) RADIOFREQUENCY FILTER WITH DIELECTRIC ELEMENT

(71) Applicant: THALES, Neuilly sur Seine (FR)

(72) Inventors: Damien Pacaud, Beaumont sur Leze (FR); Nicolas Jolly, Bosmie l'Aiguille (FR)

(73) Assignee: THALES, Courbevoie (FR)

( * ) Notice: Subject to any disclaimer, the term of this patent is extended or adjusted under 35 U.S.C. 154(b) by 521 days.

(21) Appl. No.: 14/260,791

(22) Filed: Apr. 24, 2014

(65) Prior Publication Data

US 2014/0320237 A1 Oct. 30, 2014

(30) Foreign Application Priority Data

Apr. 26, 2013 (FR) ..... 13 00974

(51) Int. Cl.
*H01P 7/10* (2006.01)
*H01P 1/208* (2006.01)
*H01P 1/219* (2006.01)

(52) U.S. Cl.
CPC ..... *H01P 1/2086* (2013.01); *H01P 1/219* (2013.01); *H01P 7/10* (2013.01)

(58) Field of Classification Search
CPC ..... H01P 1/2086; H01P 1/219; H01P 7/10
USPC ..... 333/202–212, 219, 219.1
See application file for complete search history.

(56) References Cited

U.S. PATENT DOCUMENTS 5,880,650 A 3/1999 Latouche et al.
6,433,652 B1 * 8/2002 Hattori et al. ..... 333/134
6,462,634 B2 * 10/2002 Latouche et al. ..... 333/202
6,518,858 B2 * 2/2003 Ando et al. ..... 333/134
8,031,036 B2 10/2011 Panariello et al.
2006/0097827 A1 5/2006 Lagorsse et al.

OTHER PUBLICATIONS

Valerie Madrangeas, et al, "Analysis and Realization of L-Band Dielectric Resonator Microwave Filters", IEEE Transactions on Microwave Theory and Techniques, Jan. 1, 1992, pp. 120-127, vol. 40, No. 1, IEEE Service Center, Piscataway, NJ, USA, XP000244297.

Ji-Fug Liang, et al., "Mixed Modes dielectric Resonator Loaded Cavity Filters", Microwave Symposium Digest, May 23, 1994, pp. 731-734, IEEE, New York, NY, USA, XP010586687.

* cited by examiner

*Primary Examiner* — Dinh Le
(74) *Attorney, Agent, or Firm* — Baker & Hostetler LLP

(57) ABSTRACT

A radiofrequency filter exhibiting at least one resonant mode comprises: at least one cavity at least partially closed using conductive walls, having a cylindrical outer surface defined by a directing curve described by a generatrix and having a point of symmetry, an axis passing through a point of symmetry and parallel to the generatrix being a longitudinal axis of the cavity. At least one dielectric element is arranged in the cavity and comprises: a first portion having a thickness according to the longitudinal axis and a section according to a plane perpendicular to the longitudinal axis whose vertices are distributed according to a polygon, at least two vertices being short-circuited between them by the conductive walls of the cavity, via an electrical or radiofrequency contact between the vertices and walls, at least one pyramidal portion comprising an apex and a base coinciding with an extreme section of the first portion.

18 Claims, 11 Drawing Sheets

RADIOFREQUENCY FILTER WITH DIELECTRIC ELEMENT

CROSS-REFERENCE TO RELATED APPLICATION

This application claims priority to foreign French patent application No. FR 1300974, filed on Apr. 26, 2013, the disclosure of which is incorporated by reference in its entirety.

FIELD OF THE INVENTION

The present invention relates to the field of filters for radiofrequency waves, typically with a frequency of between 1 GHz and several tens of GHz.

Processing a radiofrequency wave, for example received by a satellite, entails developing specific components, allowing for the propagation, amplification and filtering of this wave. In practice, the radiofrequency wave received by a satellite must be amplified before being returned to the ground. This amplification is possible only by separating all the received frequencies into channels, each corresponding to a given frequency band. The amplification is then done channel by channel. Then, the signal is recombined before being sent to the transmitting antenna.

Filters are thus used to produce input multiplexers (called IMUX) or output multiplexers (called OMUX). A filter can be excited only by a relatively narrow frequency band about a resonance frequency.

The filter according to the invention comprises at least one cavity and one dielectric element arranged inside. More particularly, the filters according to the invention are suitable for producing multiplexers of OMUX type, situated after a power amplifier. Its role is to eliminate all the spurious frequencies created by the power amplifier. The specifications of these filters are very stringent in terms of quality factor and insulation (no spurious modes in the band of interest) because of their situation between the power amplifier and the transmitting antenna.

BACKGROUND

Conventionally, the filters for radiofrequency waves comprise, in addition to one or more cavities coupled together wherein dielectric resonators are arranged, means for coupling the radiofrequency energy (RF), on the one hand, to introduce RF energy at the input of the filter and, on the other hand, to extract RF energy at the output of the filter. Furthermore, they generally comprise tuning means making it possible to adjust the frequency of the main resonant modes of the filter.

Filters known from the prior art are described for example in U.S. Pat. No. 5,880,650. In this filter, a dielectric element consists of a planar plate in the form of a parallelogram, and as much as possible of the electrical field is situated in the dielectric element, which thus acts as resonator.

One advantage of the filter described in U.S. Pat. No. 5,880,650 is that the dielectric resonator is in mechanical and electrical contact with the walls of the metallic cavity by the four vertices of the plate. The vertices are truncated or rounded so as to closely follow the form of the side walls, planar or slightly incurved depending on the form of the cavity. The mechanical contact allows for an exact and reproducible positioning of the resonant element in the cavity, and heat transfer between the resonator element and the walls is significantly improved.

One drawback with this filter exists in that, because of the location of the electrical field in the dielectric element, the dielectric losses are significant. Conversely, an empty resonant cavity exhibits significant metallic losses. Since the quality factor Q depends on the metallic losses and on the dielectric losses, an empty cavity or a cavity with dielectric resonator therefore each exhibits the drawback of significant losses, that is to say a non-optimal quality factor.

Furthermore, the filter described in U.S. Pat. No. 5,880,650 was optimized for operation in band C (from 3 to 5 GHz). For it to operate at a higher frequency (for example in band Ku from 10 to 13 GHz), the dimensions should be divided by approximately three, which leads to a small filter, which is an advantage. However, the rise in frequency leads to a degradation of the quality factor Q.

Another type of filter is described in U.S. Pat. No. 8,031,036. This filter comprises a cylindrical metallic cavity and, inside, a dielectric element, also cylindrical, comprising a collar, fixed to the walls of the cavity over its entire circumference by the collar through, for example, a ring or springs. In this filter, the electrical field is concentrated in the dielectric resonator with the abovementioned drawbacks. Furthermore, the volume of the resonator cylinder is significant, leading to a heavy filter, which constitutes a notable drawback for components intended to be installed on a satellite.

One aim of the present invention is to remedy the abovementioned drawbacks.

SUMMARY OF THE INVENTION

The subject of the present invention is a radiofrequency filter exhibiting at least one resonant mode comprising at least one cavity at least partially closed using conductive walls and having a cylindrical outer surface defined by a directing curve described by a generatrix and having a point of symmetry, an axis passing through a point of symmetry and parallel to said generatrix being called longitudinal axis of the cavity and at least one dielectric element arranged in said cavity and comprising:

- a first portion having a thickness according to said longitudinal axis and a section according to a plane perpendicular to said longitudinal axis whose vertices are distributed according to a polygon, and of which at least two vertices are short-circuited between them by the conductive walls of the cavity, via an electrical or radiofrequency contact between the vertices and the walls,
- at least one pyramidal portion comprising an apex and a base coinciding with an extreme section of the first portion.

Advantageously, the directing curve is chosen from a square, a rectangle, a hexagon, a circle, an ellipse.

Advantageously, the base comprises vertices distributed according to a regular polygon.

Advantageously, all the vertices of the section are short-circuited between them by the conductive walls of the cavity, via an electrical or radiofrequency contact between the vertices and the walls.

Advantageously, the filter according to the invention comprises a top pyramidal portion and a bottom pyramidal portion respectively comprising a top base coinciding with a top extreme section and a bottom base coinciding with a bottom extreme section of the first portion.

Advantageously, the top pyramidal portion and the bottom pyramidal portion are identical.

Advantageously, the apex is arranged on the longitudinal axis.

Advantageously, the barycentre of said polygon is arranged on the longitudinal axis.

Advantageously, an angle between the base and a face of the pyramidal portion is less than or equal to 45°.

Advantageously, the pyramidal portion is truncated on a plane at right-angles to the longitudinal axis.

Advantageously, the truncated pyramidal portion has a recess produced on a top face of the truncated pyramidal portion.

Advantageously, at least one recess is produced at any point on the perimeter of the dielectric element.

Advantageously, the filter according to the invention is dimensioned such that a resonance frequency of a resonant mode is between 3 GHz and 30 GHz.

Advantageously, an electromagnetic field corresponding to a resonant mode comprises an even number 2n of zones for which the electromagnetic field exhibits a maximum, the zones being arranged in equal numbers n on either side of the first portion of the dielectric element, n being chosen from 1, 2 and 3.

Advantageously, each of the zones is distributed partially inside and partially outside the pyramidal portion positioned on the same side as the zone.

Advantageously, the filter according to the invention comprises at least one input cavity and one output cavity, and comprises input coupling means for a radiofrequency wave originating from an external source with said input cavity and output coupling means between said output cavity and an external waveguide, and comprises intermediate coupling means for coupling the cavities together.

BRIEF DESCRIPTION OF DRAWINGS

Other features, aims and advantages of the present invention will become apparent on reading the following detailed description and in light of the attached drawings given by way of nonlimiting examples and wherein.

DETAILED DESCRIPTION

One aim of the invention is to produce a filter for radiofrequency waves exhibiting very good performance levels both in terms of quality factor Q and insulation.

Insulation should be understood to mean the capacity of the filter not to transmit undesirable modes other than the selected resonance modes of the filter. The frequency range around the resonance frequency for which no spurious mode is transmitted is, according to the terminology, called "spurious free range". The aim will of course be to obtain the widest possible range.

For example, for an OMUX application in band Ku (10 to 13 GHz), the aim is typically to have a range of the order of 500 MHz on either side of the resonance frequency, a non-loaded quality factor at least equal to 18 000 and a power withstand strength of at least 300 W per channel.

Figure 1A:
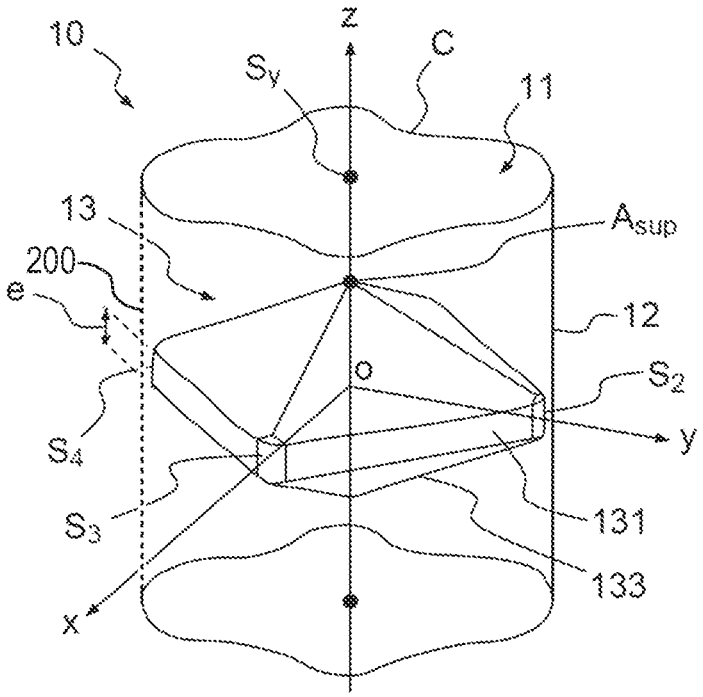
FIGS. 1*a*-1*c* schematically illustrate a filter according to the invention.

Figure 1*a* describes a perspective view of a radiofrequency filter (RF) 10 according to the invention. This filter exhibits at least one resonance mode and comprises a cavity 11 at least partially closed using conductive walls 12, typically metallic. The cavity 11 has a cylindrical outer surface defined by a directing curve C described by a straight line called generatrix 200 of the cylinder. The directing curve of the cavity of the filter according to the invention has a point of symmetry Sy, which simplifies production and simulation.

According to a preferred embodiment, for ease of production, the directing curve C is a square, a rectangle, a hexagon, a circle or an ellipse. The longitudinal axis z of the hollow cylindrical cavity is defined as the axis parallel to a generatrix 200 straight line and passing through the points of symmetry.

The filer 10 according to the invention also comprises at least one dielectric element 13 arranged in the cavity 11. The dielectric element 13 comprises a first portion 131 having a thickness e according to the axis z and a section according to a plane perpendicular to z wherein the p vertices S1, S2, . . . Sp are distributed according to a polygon P. To simplify understanding and, in a nonlimiting manner, the polygon represented in FIG. 1 is a square, but any polygon P is compatible with the invention.

According to a preferred variant, the polygon is regular (triangle, square, pentagon, hexagon, etc.) or rectangular, to allow for a low cost industrial production of the filter and an easier optimization because of the presence of axes of symmetry.

According to a preferred embodiment, the polygon is a square so as to limit the contacts between the dielectric element 13 and the cavity 11, which makes it possible to prioritize certain modes and ensure the quality of the contacts.

Similarly in FIG. 1 and in a nonlimiting manner, the sides which join the vertices together are straight-line segments, but any other form is compatible with the filter 10 according to the invention, variants of which are described later. The contact of the dielectric element 13 with the conductive wall is made through the first portion 131, according to the same principle as that described in U.S. Pat. No. 5,880,650, that is to say at least two vertices of the polygon are short-circuited between them by the walls 12, via an electrical or radiofrequency contact between these vertices and the wall.

The method for fixing the dielectric element 13 to the walls 12 thus offers the same advantages as those described in U.S. Pat. No. 5,880,650, such as:

- assembly of the filter simplified by an exact and absolute positioning of the dielectric element without having to use securing elements.
- heat transfer between the element and the walls significantly enhanced.

The method for fastening the dielectric element to the walls is also compatible with the same variants, for example:

- truncated or rounded vertices, as described in FIG. 1, to closely follow the form of the side walls, planar or rounded depending on the form of the directing curve C of the cylindrical cavity,
- truncation of the vertices according to dimensions slightly less than the transversal dimensions of the cavity so as to leave a small space, which may be empty or filled with dielectric or conductive and/or elastic material,
- use of securing pillars,
- truncation of the vertices according to dimensions slightly greater than the transversal dimensions of the cavity and production of notches, etc.

It is not necessary for all the vertices of the polygon P to be short-circuited between them, it is sufficient for the vertices short-circuited by the walls 12 to be in sufficient numbers to ensure a correct positioning of the dielectric element in the cavity.

According to a preferred variant, for a better positioning accuracy, all the vertices S1 . . . Sp of the polygon P are short-circuited between them by the conductive walls.

The dielectric element 13 also comprises at least one pyramidal portion 132, 133 as illustrated in FIGS. 1*a* (perspective view), 1*b* (profile view) and 1*c* (plan view). The pyramidal portion comprises an apex Asup, Ainf, vertex of the pyramid, and a base Bsup, Binf, which coincides with an extreme section 134, 135 of the first portion 131. "Extreme section" should be understood to mean the top section 134 and the bottom section 135 of the first portion 131 of thickness e.

The particular form of the dielectric element associated with an optimized dimensioning (cavity and dielectric element) makes it possible to obtain a filter with performance levels that are enhanced compared to those of the filters of the prior art.

According to a variant, the dielectric element 13 comprises a single pyramidal portion, bottom 132 or top 133.

According to a preferred variant, the dielectric element 13 comprises two pyramidal portions on either side of the first portion 131, the top base Bsup coinciding with the top extreme section 134 and the bottom base Binf coinciding with the bottom extreme section 135 of the first portion 131.

In order to simplify the calculations for optimizing the dielectric element in the cavity, according to a preferred embodiment, the top and bottom pyramidal portions are identical. According to a preferred embodiment, the filter according to the invention comprises a plane of symmetry xy. The existence of a symmetry in the form of the dielectric element makes it possible to obtain a better insulation, because of the symmetry of the modes which devolve therefrom. A distortion of the modes renders the behaviour of the filter non-optimal.

Preferentially, the filters according to the invention operate according to a TE (transverse electrical) mode.

Figure 2:
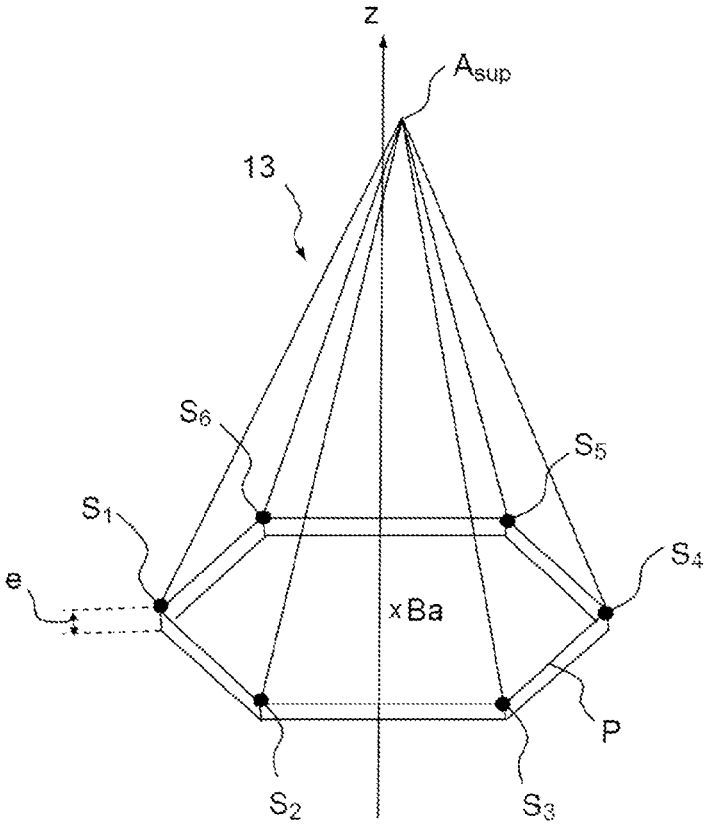
FIG. 2 describes an exemplary pyramidal structure of the dielectric element.

FIG. 2 schematically illustrates an exemplary pyramidal structure whose base consists of vertices arranged on a polygon P of barycentre Ba, and of apex Asup. In this example, the barycentre Ba and the apex Asup are not arranged on the longitudinal axis z of the cylindrical cavity.

Figure 1B:
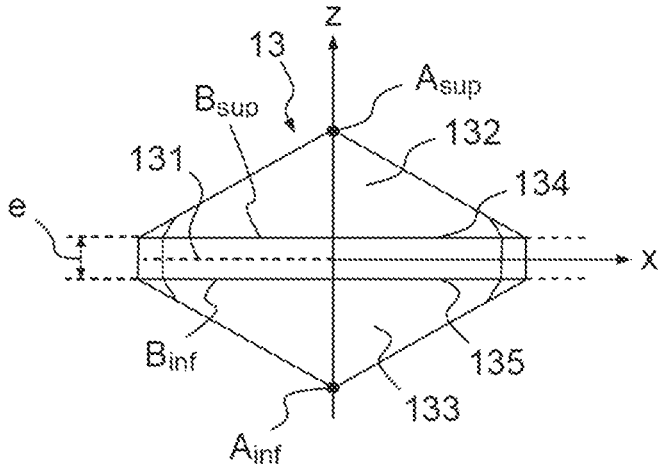
Figure 1C:
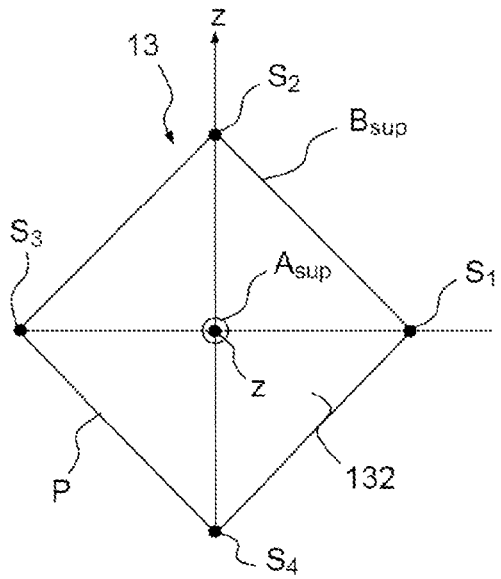

In order to simplify the optimization calculations, according to a preferred variant illustrated in FIGS. 1*a*, 1*b* and 1*c*, the apexes Asup and Ainf of the pyramidal portions are arranged on the longitudinal axis z of the cavity 11.

In order to position and fix the dielectric element 13 more easily in the cavity 11, according to a preferred variant, the barycentre Ba of the polygon P serving as base for the pyramidal portion is arranged on the longitudinal axis z of the cavity 11, as illustrated in FIGS. 1*a*, 1*b*, 1*c*.

Preferentially, the dielectric element 13 is produced from a single block, which offers the advantage of simplifying the industrial production of the element 13, obtained by moulding, machining or grinding or by additive manufacture (stereolithography).

Figure 3A:
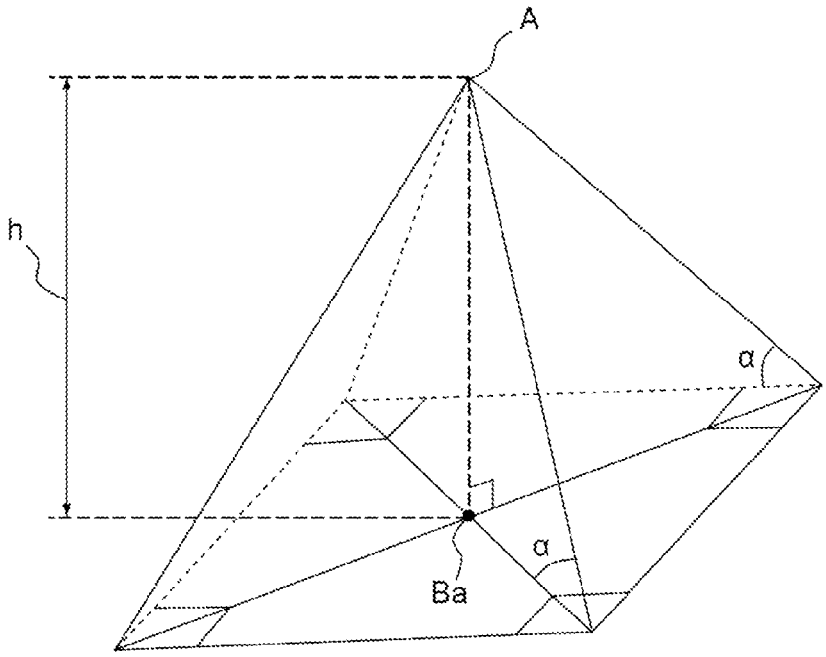
FIGS. 3*a*-3*b* illustrate a preferred embodiment of a pyramidal portion.
Figure 3B:
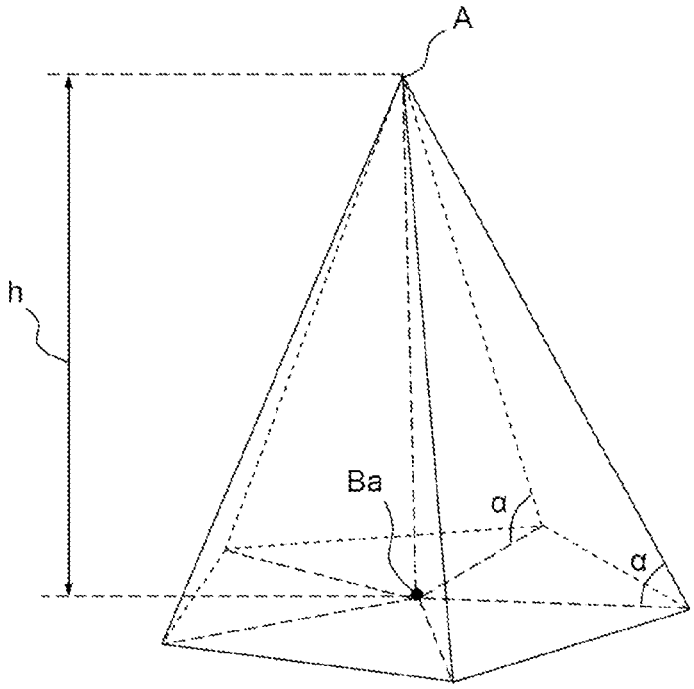

FIG. 3 illustrates a preferred embodiment of a pyramidal portion, whose base is a regular polygon (3*a*: square, 3*b*: pentagon) whose apex A has a projection orthogonal to the base, defining a height h, which passes through the barycentre Ba of the polygon.

Examples of this particular pyramidal portion case are the regular tetrahedron, square pyramid (FIG. 3*a*), pentagonal pyramid (FIG. 3*b*), hexagonal pyramid, etc.

The angle between the base of the pyramid and a face of the pyramid is called angle $\alpha$. According to a preferred embodiment, the angle $\alpha$ (or all the angles $\alpha$ when they are not equal) is(are) less than or equal to 45°.

Figure 4A:
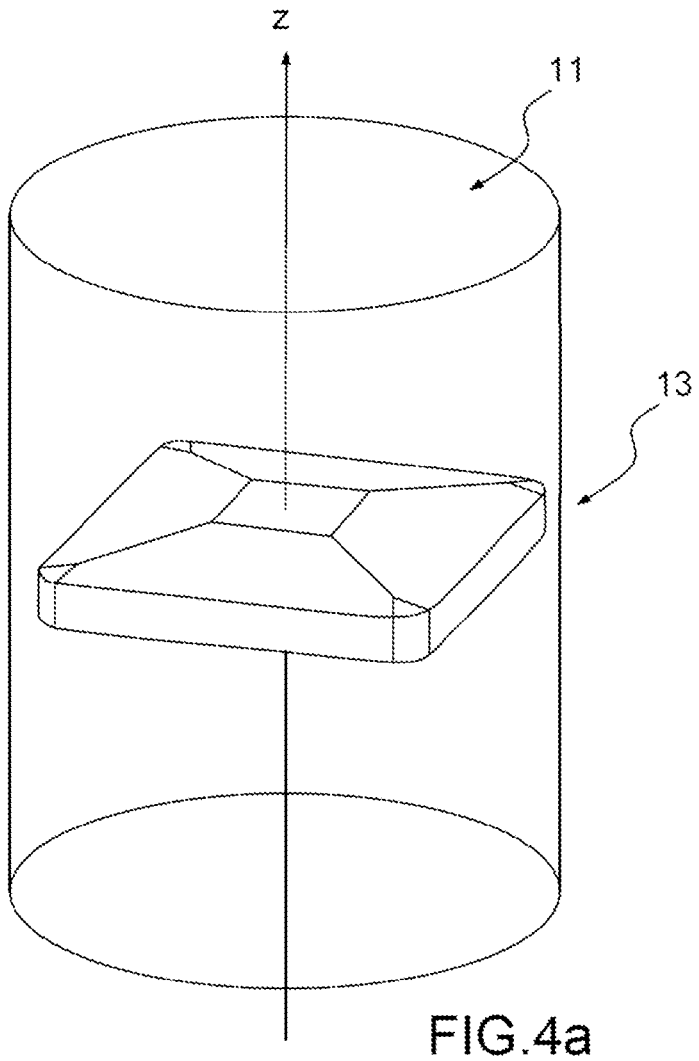
FIG. 4*a*-4*b* illustrate a variant dielectric element comprising a truncated pyramidal portion.
Figure 4B:
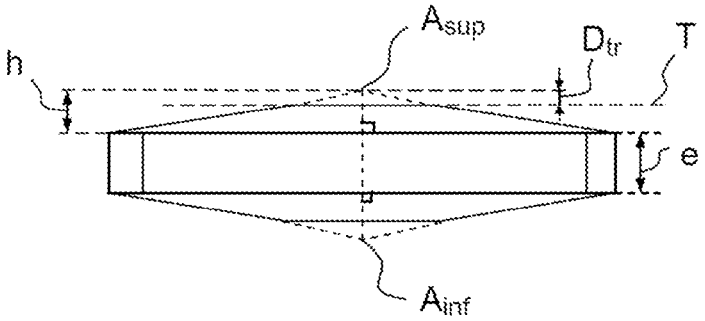

FIG. 4 represents a variant dielectric element 13 inside a cylindrical cavity 11 of directing curve C according to a circle (circular cylinder). FIG. 4*a* illustrates a perspective view, FIG. 4*b* a profile view.

According to this variant, the pyramidal portion is truncated, for example along a plane T at right-angles to the longitudinal axis z. The apex is then virtual.

The truncation is defined by a distance Dtr corresponding to the fraction k of the height for which the material has been eliminated.

$$Dtr = k \times h$$

The truncation offers the advantage of limiting the sensitivity of the filter performance levels to the value of the angle $\alpha$.

Preferentially, k is between 0.1 and 0.5. For lower values of k, the advantage of the truncation is not significant. For higher values of k, the quality factor Q decreases substantially.

Figure 5A:
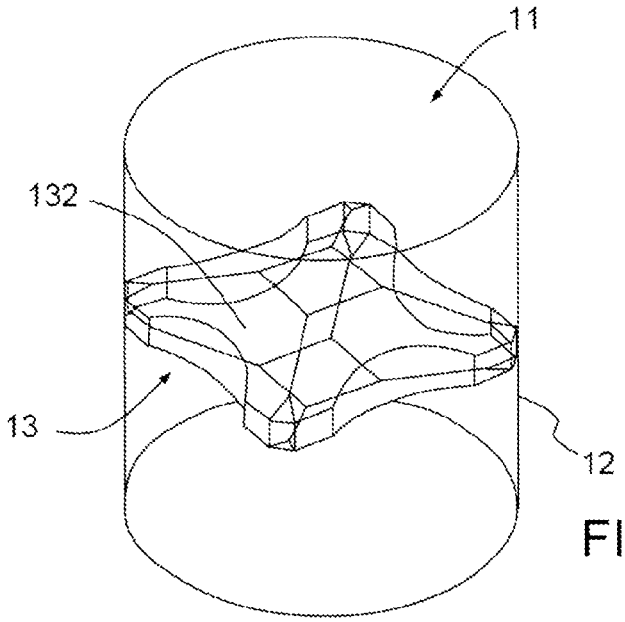
FIG. 5*a*-5*c* illustrate a variant dielectric element comprising recesses.
Figure 5B:
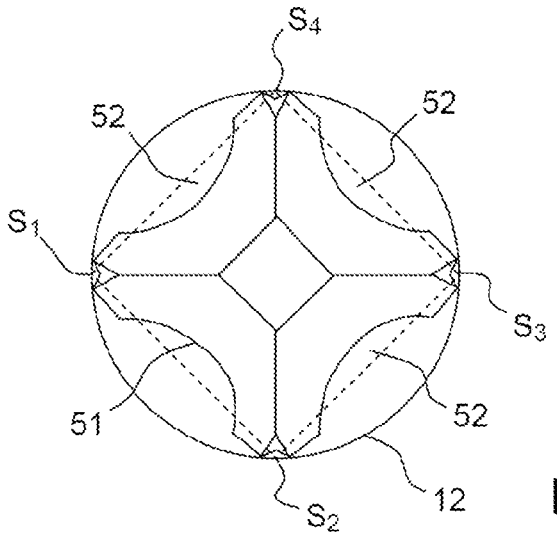
Figure 5C:
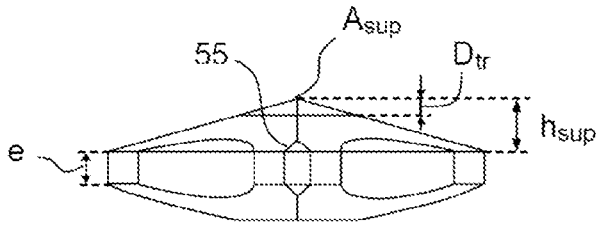

FIG. 5 represents another variant dielectric element 13 inside a cylindrical cavity 11 of directing curve C according to a circle. FIG. 5*a* illustrates a perspective view, FIG. 5*b* a plan view and FIG. 5*c* a profile view. In the example of FIG. 5, the polygon is a square: the 4 vertices S1, S2, S3 and S4 are distributed according to a square.

In the example illustrated in FIG. 5, the perimeter 51 of the dielectric element is rounded (chamfer 55) in the vicinity of the vertices to closely follow the form of the cylindrical wall.

According to this variant illustrated in FIG. 5, the perimeter 51 of the dielectric element 13 does not coincide with the sides of the square according to which the vertices are distributed. Thus, at least one recess 52 is produced at any point on the perimeter 51 of the dielectric element 13. Preferentially, all the sides of the polygon have a recess 52 to ensure symmetry of the electromagnetic field.

This involves removing dielectric material in the zones where the electrical field is of weak intensity. One advantage is that a smaller dielectric volume is obtained. Another advantage is that a better insulation is obtained by controlling the frequency of the other modes (spurious modes) which depend more strongly on this dielectric part.

Preferentially, the recess is produced in such a way as to not add right-angled edges.

The filter of FIG. 5 has a dielectric element which combines recess and truncation. These two variants are independent.

In the design of a radiofrequency filter according to the invention, the resonance frequencies depend primarily:

- on the dimensions (thickness and transversal dimensions of the first portion, height of pyramidal portion) and on the form (square, pentagonal, hexagonal base) of the dielectric element,
- on the dimensions and on the form of the resonant cavity wherein the dielectric element is arranged,
- on the dielectric material used to produce the latter.

The values of these variables therefore depend on the radiofrequency band wherein the filter operates. According to a preferred variant, the filter according to the invention is dimensioned to operate in the bands C, X and Ku and Ka, that is to say comprising a resonance frequency within the range [3 GHz; 30 GHz].

An example of dimensioning for a resonance frequency of 12 GHz is:

Metallic cavity:

- circular cylindrical of diameter between 20 and 25 mm and of length between 20 and 25 mm.

Dielectric element:

- square base closely following the form of the cavity for the 4 vertices,
- thickness e of the first portion between 2 and 4 mm,
- angle $\alpha$ of the pyramid: between 8° and 11°,
- dielectric permittivity: 9.5 and 10.

For these dimensions, a non-loaded quality factor of between 18 000 and 19 000 and a total range insulation between 1 GHz and 1.5 GHz around the resonance frequency were calculated with a temperature-compensated dielectric.

The presence of a recess enhances the insulation range, the presence of a truncation reduces the sensitivity of the resonance frequency to the value of the angle of the pyramid, thus relaxing the manufacturing constraints of the dielectric element.

From an electromagnetic point of view, two types of filters are conventionally distinguished based on the manner wherein the dielectric element is used.

In a first type, the dielectric element is used as resonator, which means that the electrical field is concentrated inside it. The "resonator modes" (also called dielectric modes) are thus modes for which the electrical energy is concentrated mainly in the dielectric material (typically 90 to 95%). Their losses are essentially dielectric and depend on the characteristics of the material (losses tangent).

Conversely, in a second so-called "cavity modes" type, the resonant cavity is said to be "loaded" by the dielectric element which modifies the dielectric permittivity of the medium. The losses are essentially metallic.

An enhanced mode of operation of the filter according to the invention is called "hybrid", and consists in loading the cavity with a dielectric in order to partially concentrate the electrical energy therein, so as to reduce the metallic losses while limiting the dielectric losses. The electromagnetic operation of the filter according to the invention thus combines the two types of conventional operation, which makes it possible, partly by virtue of the specific form of the dielectric element, to minimize the losses (high quality factor) while maintaining a good insulation.

In "hybrid" operation, the resonant mode exhibits an even number 2n of zones for which the electrical field exhibits a maximum, the zones being arranged in equal numbers on either side of the first portion 131 of the dielectric element 13.

In practice, only the values n=1, n=2, n=3 and n=4 offer any practical benefit. In practice, the higher the order number rises, the more maxima there are, and beyond 4 maxima on each side, the insulation becomes insufficient.

Given constant dimensions, the higher n becomes, the higher the resonance frequency of the corresponding mode. It is therefore essential to increase the dimensions to bring this resonance frequency to the frequency of the filter.

When a filter is produced per channel, one option is to use, for each channel, a filter of identical structure and operating in the same mode, but of proportionally scaled dimensions, to obtain proportional and determined resonance frequencies.

Figure 6A:
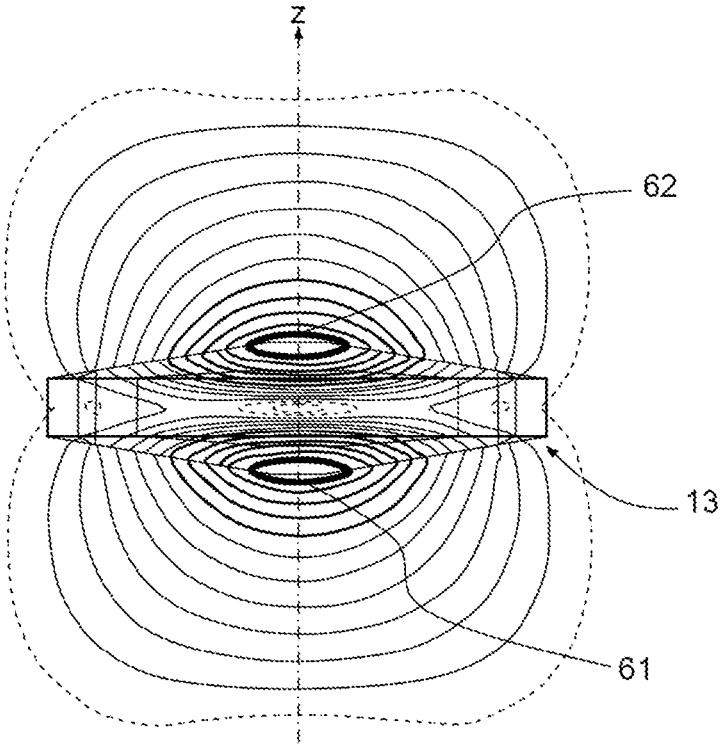
FIGS. 6*a*-6*b* illustrate the distribution of the field lines for an embodiment of the filter according to the invention.
Figure 6B:
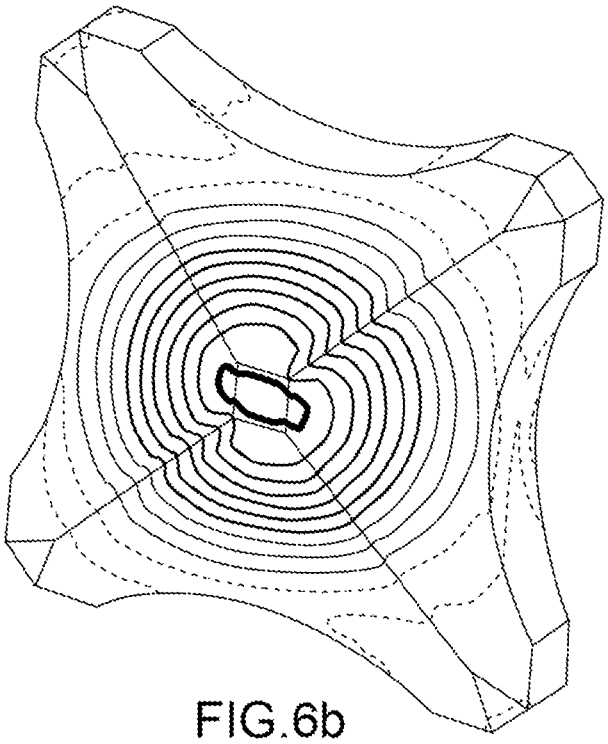
Figure 7A:
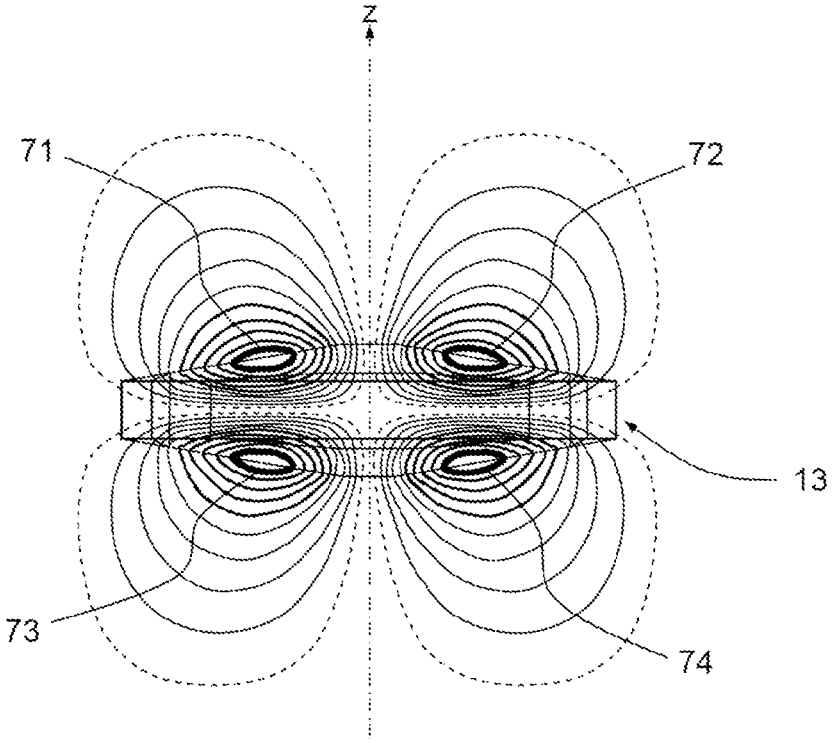
FIGS. 7*a*-7*b* illustrate the distribution of the field lines for another embodiment of the filter according to the invention.
Figure 7B:
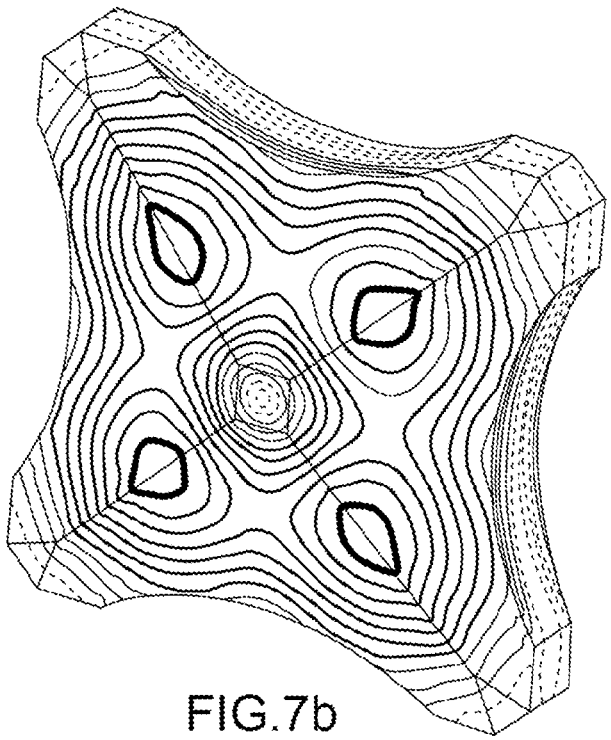

In an enhanced embodiment of the filter according to the invention illustrated in FIGS. 6 and 7, each of the zones for which the electrical field exhibits a maximum is distributed partially inside and partially outside the pyramidal portion positioned on the same side as the zone in question.

According to the "plate" prior art, the plates are positioned on the field maxima in order to concentrate the electrical energy there.

For a filter according to the invention, intrinsically hybrid, the first portion of the dielectric (common base of the pyramids) is positioned on a field minimum (between the 2 field maxima). Since the dielectric still has a tendency to concentrate the electrical energy, by adjusting the dimensions of the pyramid, this energy is partially concentrated, partly inside, partly outside, the dielectric, optimally.

One advantage of using a "hybrid" mode wherein the field maximum is located partially outside the dielectric and partially inside consists in obtaining dielectric losses lower than those obtained for a conventional resonator type mode and metallic losses lower than those obtained for a conventional loaded cavity type mode.

FIG. 6 illustrates a filter 10 according to the invention operating in "hybrid" mode, wherein the dielectric element comprises two square pyramids, truncated and with recesses in a circular cylindrical cavity 11 as illustrated in FIG. 5, the contact between element 13 and wall 12 being made by the four vertices of the square, as well as the distribution of the field lines of the resonant mode in the cavity. FIG. 6 also illustrates the distribution of the field lines in such a way as to highlight the position of the field maxima, for example for a polarization. FIG. 6*a* represents a profile view, and FIG. 6*b* a perspective view.

It can be seen in FIG. 6*a* that there are two zones which concentrate the electrical field, each arranged on either side of the first portion of the dielectric element (case n=1). The zones 61 and 62 correspond to the points for which the electrical field exhibits a maximum. Each zone 61, 62 is distributed partially in the dielectric element and partially outside it. By concentrating the electrical energy at the centre of the cavity, partially inside the dielectric, the metallic losses are substantially reduced, while limiting the dielectric losses.

FIG. 7 illustrates the same filter as that of FIG. 6 wherein a resonant mode exhibiting eight zones is favoured, four in cross section (71 and 72; 73 and 74) which concentrate the electrical field on either side of the first portion of the dielectric element (case n=4). FIG. 6*a* represents a profile view and FIG. 6*b* a perspective view of the dielectric element 13 and of the distribution of the field lines.

To obtain a resonant mode with eight maxima, it is advisable for example to find a resonance frequency on this mode, without modifying the dimensions of the cavity and of the dielectric 13.

For example, the resonance frequency of the mode n=4 is 14.5 GHz when the resonance frequency of the mode n=1 is 12 GHz, all other things remaining equal.

Figure 8A:
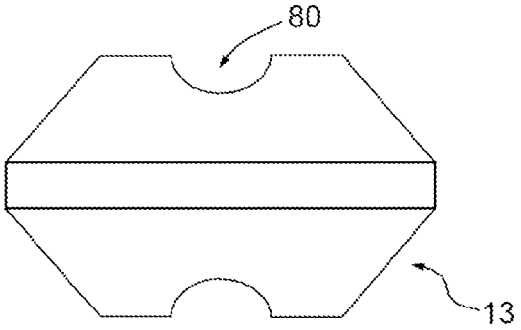
FIGS. 8*a*-8*b* schematically illustrate a variant embodiment of the dielectric element of the filter according to the invention.
Figure 8B:
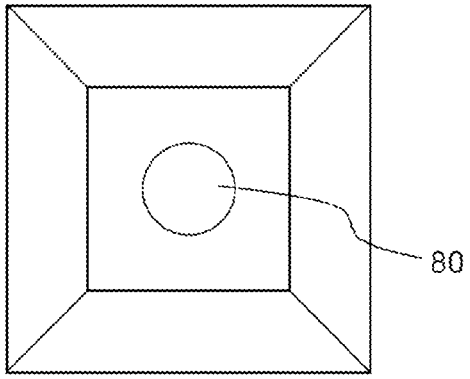

Another variant of the form of the dielectric element is illustrated in FIG. 8. The truncated pyramid has a recess 80 produced on a top face of the truncated pyramidal portion.

The recess is of any form, for example an emerging hole, or an inverted pyramid and is positioned in a zone exhibiting a weak electrical field. This variant is advantageous for the case n=4 (see FIG. 7) wherein the electrical field at the centre of the truncated part is weak. Producing this recess according to optimal dimensions makes it possible to control the frequencies of the spurious modes.

Figure 9:
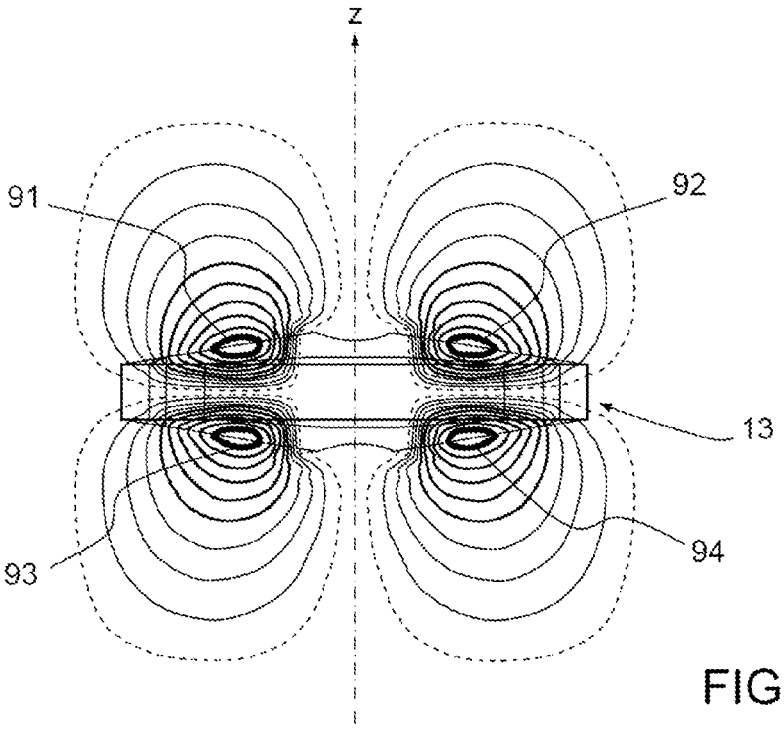
FIG. 9 illustrates the distribution of the field lines for a filter according to the invention having a dielectric element as described in FIG. 8.

FIG. 9 illustrates the distribution of the field lines of the resonant mode in the cavity, with a truncated pyramid, whose truncated planar part is hollowed, for a mode n=4. The recess disturbs the distribution of the maxima of the electrical field very little, partially inside and partially outside the pyramidal portion.

Figure 10:
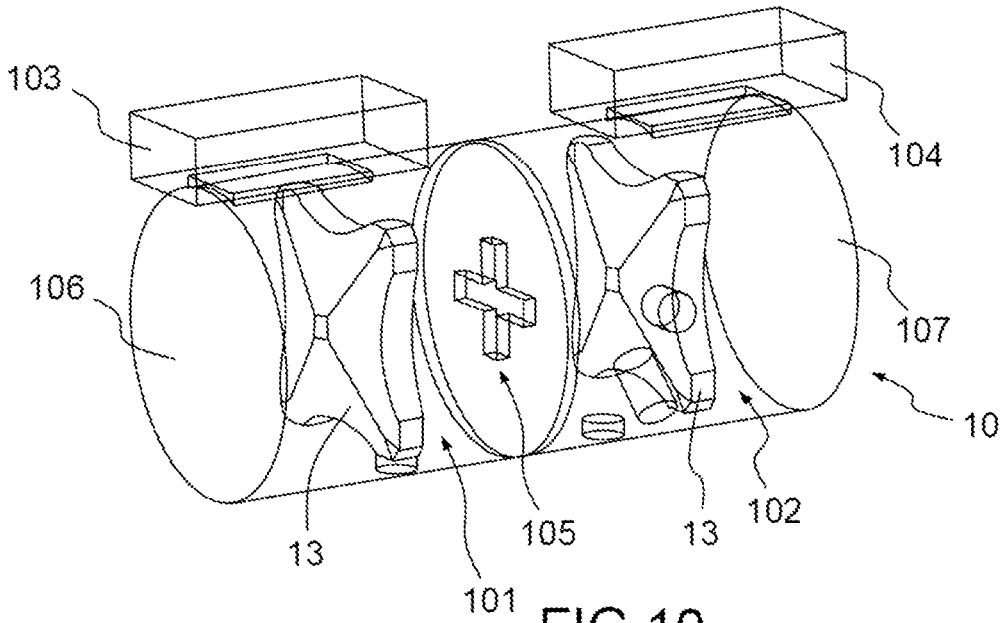
FIG. 10 illustrates a first exemplary embodiment of a filter according to the invention.

A first exemplary embodiment of a filter 10 according to the invention is schematically illustrated in FIG. 10. The filter comprises at least one input cavity 101 and one output cavity 102, input coupling means 103 for a radiofrequency wave originating from an external source with the input cavity 101 and output coupling means 104 between the output cavity 102 and an external waveguide, and comprises intermediate coupling means 105 for coupling the cavities together. Metallic transversal walls 106 and 107 at least partially close the input and output cavities.

The filter may also comprise one or more intermediate cavities coupled together, as described in FIG. 1 of the document U.S. Pat. No. 5,880,650. All these cavities are, for example, defined electrically inside a cylindrical waveguide section through a plurality of walls transversal to the longitudinal axis of the cylinder 106, 105, 107, which close the cavities at least partially at the two ends of each cavity. The materials used to construct the waveguide and the transversal walls are those commonly used by those skilled in the art for such a production. The input and output coupling means are also those used commonly by those skilled in the art.

The intermediate coupling means are conventionally different forms of slots or of irises, or capacitive probes, inductive irises or a combination of the two.

The filter according to the invention may also comprise resonance frequency tuning means known to those skilled in the art.

In FIG. 10, a dielectric element according to the invention is arranged inside a cavity, but the filter according to the invention may also comprise a plurality of pyramidal dielectric elements per cavity, possibly combined with plate-type dielectric elements such as those described in U.S. Pat. No. 5,880,650.

For example, with a single dielectric element per cavity, the element is preferentially positioned in the middle of the cavity. With two dielectric elements per cavity, an element is positioned on either side of the middle of the cavity.

Figure 11:
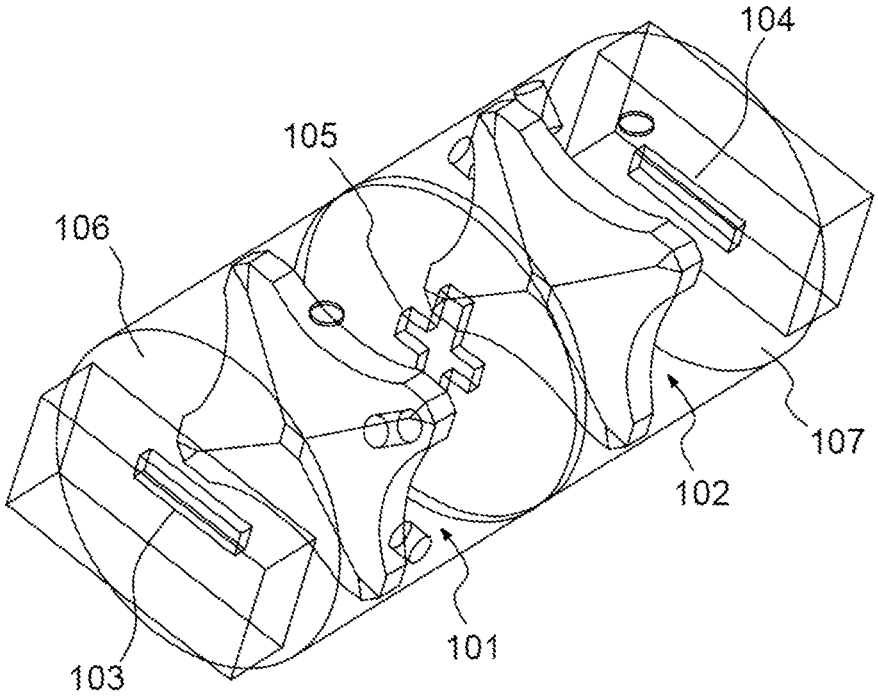
FIG. 11 illustrates a second exemplary embodiment of a filter according to the invention.

Another exemplary embodiment of a filter according to the invention is described in FIG. 11, for which the input and output coupling means 103, 104 are positioned on the transversal walls 106, 107, in a so-called "in-line" configuration.

Figure 12:
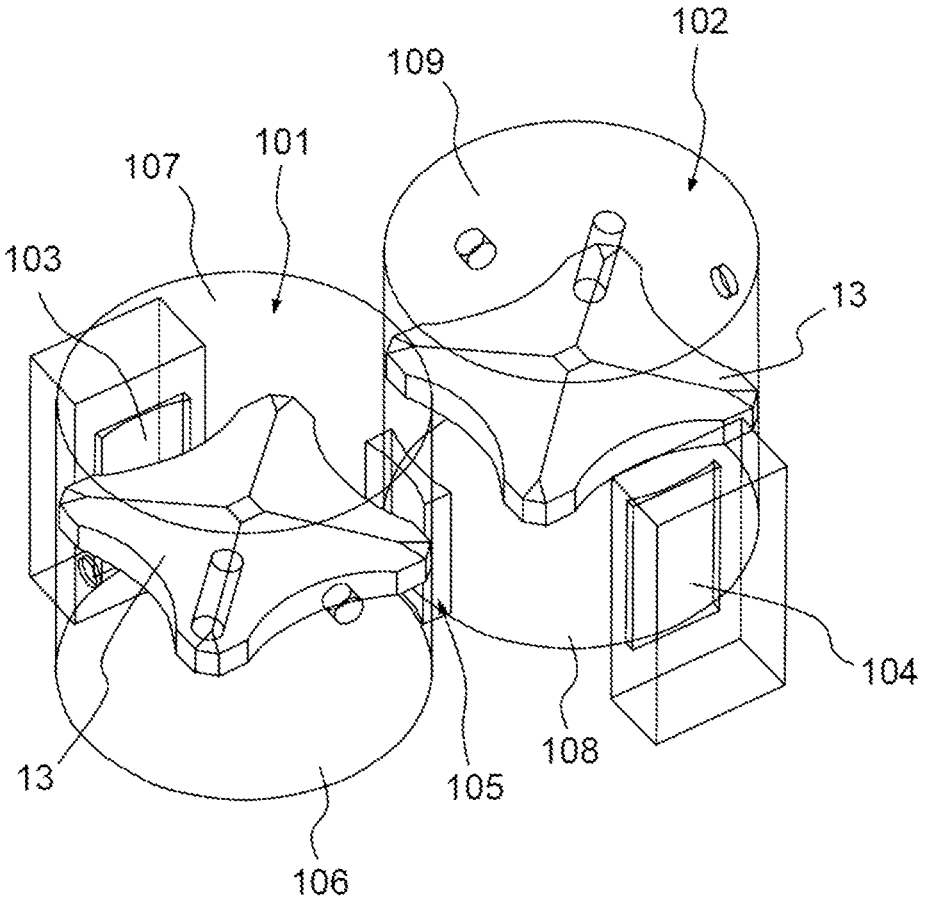
FIG. 12 illustrates a third exemplary embodiment of a filter according to the invention.

FIG. 12 illustrates a third exemplary embodiment of a filter according to the invention comprising an input cavity and an output cavity. According to this example, there is no single waveguide section, but two cylindrical parts of parallel longitudinal axes, each cavity being at least partially closed by transversal walls 106, 107 for the input cavity and 108, 109 for the output cavity. The input and output coupling means are arranged on the cylindrical wall of the corresponding cavity.

With a filter according to the configurations illustrated in FIG. 10 or 12, it is possible to locate an external temperature compensation system, as described in the patent US2006097827, on the covers 106, 107, 108 and 109. It is thus possible to use non-temperature-compensated dielectrics which makes it possible to substantially increase the non-loaded quality factor (typically 25 000).

Figure 13:
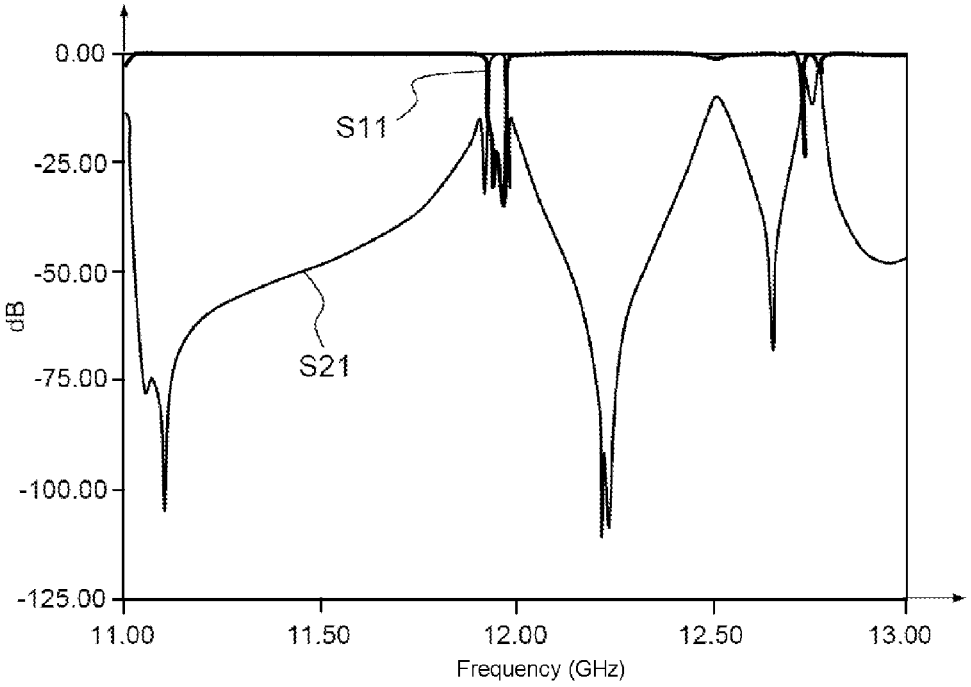
FIG. 13 illustrates an exemplary frequency response over a wide band of a filter according to the invention.
Figure 14:
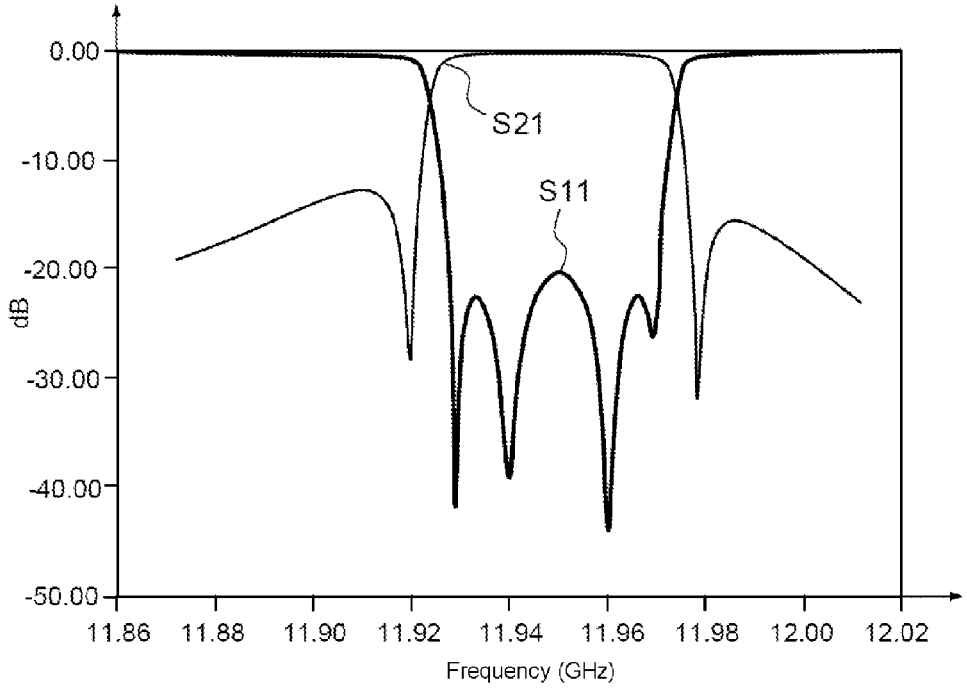
FIG. 14 illustrates an exemplary frequency response in the vicinity of the resonance frequency of a filter according to the invention.

FIGS. 13 and 14 illustrate the frequency response of a filter 10 according to the invention as illustrated in FIG. 10 and dimensioned for a resonance frequency of 12 GHz. The parameter S is a parameter which takes into account the performance levels of the filter in terms of reflection and transmission. The curve S11 corresponds to the reflection and S12, or S21, to the transmission. The tuning of the filter makes it possible to obtain a transmission maxima (reflection minima) for a given frequency band. The bandwidth of the filter is determined with equiripple of S11 (or S22), for example with 15 dB or 20 dB reduced reflection compared to its outbound level.

FIG. 13 illustrates the wideband response and a good insulation compared to the spurious modes can be seen. FIG. 14 corresponds to a zoom around the resonance frequency and illustrates the response within the bandwidth. The filter comprises 4 poles and is centred around 11.950 GHz, and the bandwidth is 40 Mhz.

The invention claimed is:

1. A radiofrequency filter exhibiting at least one resonant mode, the radiofrequency filter comprising:

conductive walls that define at least one cavity that is at least partially closed and includes:

a cylindrical outer surface defined by a directing curve that is symmetrical about a point of symmetry, and a longitudinal axis that passes through said point of symmetry; and at least one dielectric element arranged in said cavity and including:

a first portion that has a thickness along said longitudinal axis and extends along a plane perpendicular to said longitudinal axis between vertices of the first portion that are arranged according to a shape of a polygon, a top pyramidal portion that includes a top base that coincides with a top extreme section of said first portion, and a bottom pyramidal portion including a bottom base that coincides with a bottom extreme section of said first portion, wherein at least two vertices of said vertices are short-circuited together by said conductive walls via an electrical or radiofrequency contact between said vertices and said conductive walls, and wherein said top pyramidal portion and said bottom pyramidal portion are identical.

2. The filter according to claim 1, wherein said directing curve is is one of a square, a rectangle, a hexagon, a circle, and an ellipse.

3. The filter according to claim 1, wherein at least one of said top base and said bottom base comprises vertices arranged according to a regular polygon.

4. The filter according to claim 1, wherein all of said vertices are short-circuited together by said conductive walls of said cavity via the electrical or radiofrequency contact between said vertices and said conductive walls.

5. The filter according to claim 1, wherein an apex of at least one of said top pyramidal portion and said bottom pyramidal portion is arranged on said longitudinal axis.

6. The filter according to claim 1, wherein a barycentre of said shape of said polygon corresponding to the first portion is arranged on said longitudinal axis.

7. The filter according to claim 1, wherein at least one of an angle between said top base and a face of said top pyramidal portion and an angle between said bottom base and a face of said bottom pyramidal portion is less than or equal to 45° .

8. The filter according to claim 1, wherein at least one of said top pyramidal portion and said bottom pyramidal portion is truncated along a plane at right-angles to said longitudinal axis.

9. The filter according to claim 1, wherein at least one of said top pyramidal portion and said bottom pyramidal portion is a truncated pyramidal portion that defines a recess on a top face of said truncated pyramidal portion.

10. The filter according to claim 1, wherein at least one recess is is defined by said at least one dielectric element on a perimeter of said at least one dielectric element.

11. The filter according to claim 1, dimensioned such that a resonance frequency of the at least one resonant mode is between 3 GHz and 30 GHz.

12. The filter according to claim 1, wherein an electromagnetic field corresponding to the at least one resonant mode comprises an even number 2n of zones for which said electromagnetic field exhibits a maximum, said zones being arranged in equal numbers n on either side of said first portion of said at least one dielectric element, n being chosen from 1, 2, 3 and 4.

13. The filter according to claim 12, wherein each of said zones is distributed partially inside and partially outside at least one of said top pyramidal portion and said bottom pyramidal portion positioned on a same side of the at least one dielectric element as a respective zone.

14. The filter according to claim 1, further comprising at least one input cavity and one output cavity;

input coupling means for a radiofrequency wave originating from an external source with said at least one input cavity;

output coupling means between said one output cavity and an external waveguide; and intermediate coupling means for coupling said at least one input cavity and one output cavity together.

15. A radiofrequency filter exhibiting at least one resonant mode, the radiofrequency filter comprising:

conductive walls that define at least one cavity that is at least partially closed and includes:

a cylindrical outer surface defined by a directing curve that is symmetrical about a point of symmetry, and a longitudinal axis that passes through said point of symmetry; and at least one dielectric element arranged in said cavity and including:

a first portion that has a thickness along said longitudinal axis and extends along a plane perpendicular to said longitudinal axis between vertices of the first portion that are arranged according to a shape of a polygon, at least one pyramidal portion including an apex and a base coinciding with an extreme section of said first portion, wherein at least two vertices of said vertices are short-circuited together by said conductive walls via an electrical or radiofrequency contact between said vertices and said conductive walls, wherein said at least one pyramidal portion is a truncated pyramidal portion that defines at least one recess on a top face of said truncated pyramidal portion, and wherein said at least one recess is defined by said truncated pyramidal portion on a perimeter of the dielectric element.

16. A radiofrequency filter exhibiting at least one resonant mode, the radiofrequency filter comprising:

conductive walls that define at least one cavity that is at least partially closed and includes:

a cylindrical outer surface defined by a directing curve that is symmetrical about a point of symmetry, and a longitudinal axis that passes through said point of symmetry; and at least one dielectric element arranged in said cavity and including:

a first portion that has a thickness along said longitudinal axis and extends along a plane perpendicular to said longitudinal axis between vertices of the first portion that are arranged according to a shape of a polygon, at least one pyramidal portion including an apex and a base coinciding with an extreme section of said first portion, wherein at least two vertices of said vertices are short-circuited together by said conductive walls via an electrical or radiofrequency contact between said vertices and said conductive walls, and wherein said radiofrequency filter operates in a transverse electrical mode.

17. The filter according claim 16, wherein an electromagnetic field corresponding to the at least one resonant mode comprises an even number 2n of zones for which said electromagnetic field exhibits a maximum, said zones being arranged in equal numbers n on either side of said first portion of said at least one dielectric element, n being chosen from 1, 2, 3 and 4.

18. A radiofrequency filter exhibiting at least one resonant mode, comprising:

conductive walls that define at least one cavity that is at least partially closed and includes:

a cylindrical outer surface defined by a directing curve that is symmetrical about a point of symmetry, and a longitudinal axis that passes through said point of symmetry; and at least one dielectric element arranged in said cavity and including:

a first portion that has a thickness along said longitudinal axis and extends along a plane perpendicular to said longitudinal axis between vertices of the first portion that are arranged according to a shape of a polygon, at least one pyramidal portion including an apex and a base coinciding with an extreme section of said first portion, wherein at least two vertices of said vertices are short-circuited together by said conductive walls via an electrical or radiofrequency contact between said vertices and said conductive walls, wherein an electromagnetic field corresponding to the at least one resonant mode comprises an even number 2n of zones for which said electromagnetic field exhibits a maximum, said zones being arranged in equal numbers n on either side of said first portion of said at least one dielectric element, n being chosen from 1, 2, 3 and 4, and wherein each of said zones is distributed partially inside and partially outside said at least one pyramidal portion positioned on a same side of the dielectric element as a respective zone.

* * * * *